US011110995B2

(12) United States Patent
Grall

(10) Patent No.: US 11,110,995 B2
(45) Date of Patent: Sep. 7, 2021

(54) SURFACE VESSEL WITH MOTORISED MECHANICAL PROPULSION HAVING A FUSIFORM HULL AND BALLASTED KEEL

(71) Applicant: IXBLUE, Saint-Germain-en-Laye (FR)

(72) Inventor: Sébastien Grall, Aubagne (FR)

(73) Assignee: IXBLUE, Saint-Germain-en-Laye (FR)

( * ) Notice: Subject to any disclaimer, the term of this patent is extended or adjusted under 35 U.S.C. 154(b) by 7 days.

(21) Appl. No.: 16/607,957

(22) PCT Filed: Apr. 24, 2018

(86) PCT No.: PCT/FR2018/051026
§ 371 (c)(1),
(2) Date: Oct. 24, 2019

(87) PCT Pub. No.: WO2018/197804
PCT Pub. Date: Nov. 1, 2018

(65) Prior Publication Data

US 2020/0140038 A1 May 7, 2020

(30) Foreign Application Priority Data

Apr. 27, 2017 (FR) ..... 1753690

(51) Int. Cl.
*B63B 1/06* (2006.01)
*B63B 41/00* (2006.01)
(Continued)

(52) U.S. Cl.
CPC ..... *B63B 1/06* (2013.01); *B63B 35/00* (2013.01); *B63B 41/00* (2013.01); *B63H 21/20* (2013.01);
(Continued)

(58) Field of Classification Search
CPC ..... B63B 1/06; B63B 35/00; B63B 41/00; B63B 2035/007; B63B 2035/008;
(Continued)

(56) References Cited

U.S. PATENT DOCUMENTS 3,547,065 A * 12/1970 Chauveau ..... B63B 41/00 114/138
5,860,381 A 1/1999 Fernandini et al.
(Continued)

FOREIGN PATENT DOCUMENTS

JP 2013-035361 A 2/2013

OTHER PUBLICATIONS

International Search Report, dated Jun. 15, 2018, from corresponding PCT application No. PCT/FR2018/051026.

*Primary Examiner* — Anthony D Wiest
(74) *Attorney, Agent, or Firm* — Nixon & Vanderhye

(57) ABSTRACT

Disclosed is a surface vessel with motorised mechanical propulsion including a fusiform hull and a keel in the bottom part of the hull, the hull having an elongate shape in a longitudinal direction of the vessel, the keel including, at the bottom end of same, a bulb linked to the hull by a linking part of the keel, the maximum width of the linking part being smaller than the maximum width of the bulb, the maximum length of the linking part being smaller than the maximum length of the bulb, the lengths and widths being considered respectively in the longitudinal direction of the vessel and a horizontal transverse direction perpendicular to the longitudinal direction. The hull has a total width to total length ratio of less than 0.2 and a maximum length of less than 20 metres.

20 Claims, 1 Drawing Sheet

(51) Int. Cl.
*B63B 35/00* (2020.01)
*B63H 21/20* (2006.01)

(52) U.S. Cl.
CPC ... *B63B 2035/007* (2013.01); *B63B 2035/008* (2013.01); *B63B 2211/02* (2013.01); *B63H 2021/205* (2013.01)

(58) Field of Classification Search
CPC ..... B63B 2211/02; B63B 2041/003; B63H 21/20; B63H 2021/205
See application file for complete search history.

(56) References Cited

U.S. PATENT DOCUMENTS

| | | | |
|---|---|---|---|
| 8,154,953 | B1 | 4/2012 | Sims et al. |
| 9,731,799 | B2 * | 8/2017 | Hofbauer ..... B63B 41/00 |
| 2014/0261126 | A1 | 9/2014 | Jenkins et al. |
| 2015/0210359 | A1 | 7/2015 | McClure |

* cited by examiner

SURFACE VESSEL WITH MOTORISED MECHANICAL PROPULSION HAVING A FUSIFORM HULL AND BALLASTED KEEL

TECHNICAL FIELD TO WHICH THE INVENTION RELATES

The present invention generally relates to the field of surface vessels. More particularly, it relates to a mechanically propelled surface vessel having a fusiform hull and a ballasted keel. The vessel is more particularly intended to provide a drone used in underwater measurement operations, and in particular using sonars and/or sounders.

TECHNOLOGICAL BACK-GROUND

Surface vessels are known for underwater measurement operations using sonars and/or sounders. They generally contain sonars and/or sounders arranged under the hull, in particular in bulbs of the hull, and, as for the rest, they are conventional manned vessels.

The following documents are also known: US 2014/261126, which discloses an unmanned autonomous vessel, wind-propelled thanks to a wing erected on the vessel; US 2015/210359, which discloses a surface vessel also able to move as a submersible vessel and that, in surface activity, is wind-propelled thanks to a wing. These documents give no precise indication about the sizes and performances of these vessels. JP 2013 035 361 discloses a wind-turbine vessel that is not intended to move at high speeds and that has a totally different purpose than that of the vessel of the present application.

OBJECT OF THE INVENTION

The present invention proposes a vessel specially dedicated to underwater measurements and that may be used as a manned or unmanned autonomous drone, whose travel and moves are remote-controlled and/or pre-programmed.

More particularly, it is proposed according to the invention a mechanically propelled surface vessel having a fusiform hull and a keel in the lower part of the hull, the hull being elongated in a longitudinal direction of the vessel, the keel having at its lower end a bulb linked to the hull by a linking part of the keel, the maximum width of the linking part being smaller than the maximum width of the bulb, the maximum length of the linking part being smaller than the maximum length of the bulb, said lengths and widths being considered in the longitudinal direction of the vessel and in a horizontal transverse direction perpendicular to the longitudinal direction, respectively.

According to the invention, the hull has a total width to total length ratio of less than 0.2 and a maximum length of less than 20 metres.

Other non-limitative and advantageous features of the vessel according to the invention, taken individually or according to all the technically possible combinations, are the following:

- the vessel is a drone containing remote-controlled and/or pre-programmed computer navigation equipment,
- the vessel is unmanned,
- the mechanical propulsion includes at least one electrical motor and/or internal combustion engine, operating directly or indirectly one or several propellers or one or several turbines,
- the mechanical propulsion is mixed, at least one internal combustion engine operating at least one electric generator, which in turn powers at least one electric motor operating directly one or several propellers or one or several turbines, the internal combustion engine hence indirectly operating one or several propellers or one or several turbines,
- in the case of a mechanical propulsion powered by an electric motor, the vessel further contains rechargeable batteries storing electrical energy intended for the electric motor(s) operating directly one or several propellers or one or several turbines,
- the vessel contains, on its deck, photovoltaic cells for charging the rechargeable batteries,
- the vessel is intended for acoustic measurements and it contains acoustic measurement systems including acoustic wave transmission and reception transducers, and at least the acoustic wave transmission and reception transducers are arranged in the bulb of the keel,
- the vessel contains an attitude measurement unit including attitude measurement sensors, and at least attitude measurement sensors are arranged in the bulb of the keel,
- the keel is interchangeable,
- the keel is adjustable in height under the hull so that the bulb depth with respect to the hull can be adjusted,
- the hull acts as a float,
- the ratio of the height above the waterline of the hull acting as a float and except the possible appendices thereof to the height under the waterline of the hull acting as a float and except the possible appendices thereof is lower than 0.8 and higher than 0.1,
- the vessel has a minimum length of at least 2.5 metres,
- the linking part of the keel has a substantially identical length over the whole height thereof,
- the linking part of the keel has a substantially identical maximum width over the whole height thereof,
- the ratio of the maximum width of the linking part to the maximum width of the bulb is comprised between 0.05 and 0.5.

DETAILED DESCRIPTION OF AN EXEMPLARY EMBODIMENT

The following description in relation with the appended drawings, given by way of non-limitative example, will allow a good understanding of what the invention consists of and of how it can be implemented.

Device

Figure 1:
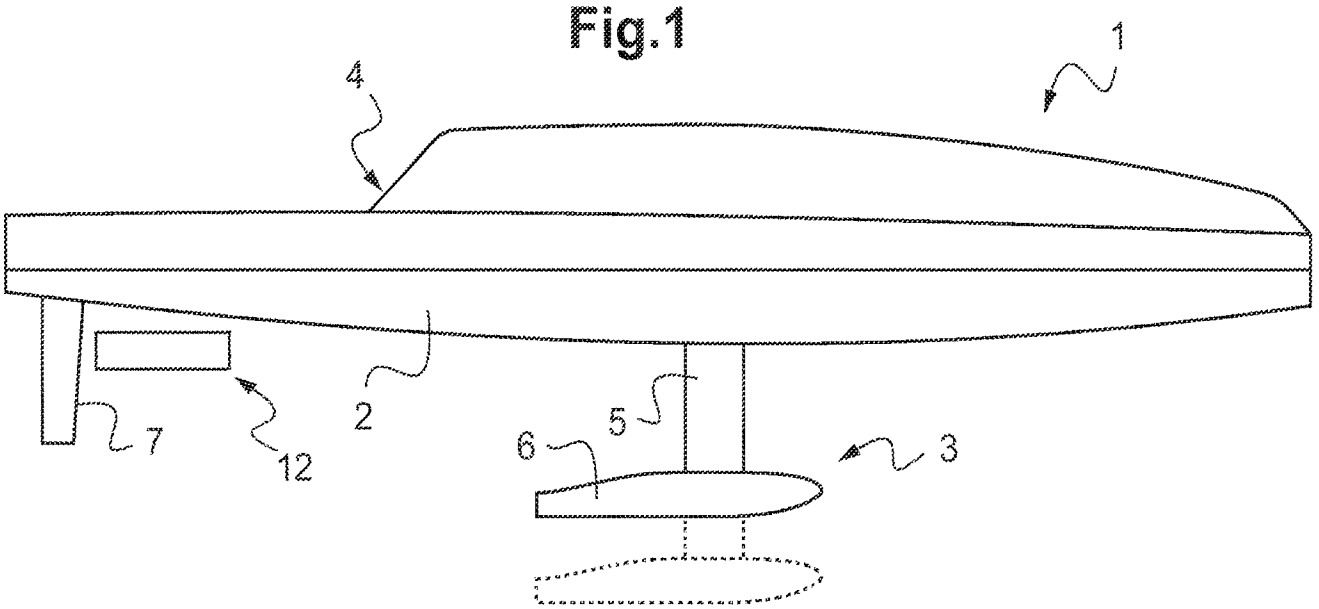
FIG. 1 is a side, i.e. lateral, view of the exemplified vessel.

FIG. 1 shows the mechanically propelled surface vessel 1 of the invention that has a very narrow fusiform hull 2. This very narrow hull provides no transverse stability to the vessel 1, which has a very tapered shape and which, with this tapered bow hull, forms a wave-piercing vessel. At the lower part of the hull 2 is arranged a keel 3 with a bulb 6. The bulb 6 being at the lower end of the keel, it is linked to the hull by a linking part 5 of the keel 3. The underwater hull, the dead works and the deck 4 are designed to be of the "wave-piercing" type, i.e. the distribution of the volumes and the heading angles are designed to minimize the vertical thrust when the hull meets the waves (buoyancy and dynamic pressures).

The keel 3 with a bulb 6 contains, preferably inside the bulb 6, a ballast that provides transversal stability to the vessel 1. This ballast is a specific heavy material, for example lead or uranium, and/or corresponds to equipment devices, in particular measurement equipment devices, arranged in the bulb 6.

The surface vessel 1 of the invention is hence distinct from the mechanically propelled ships that have a geometry providing them with a shape stability aiming at maintaining horizontal the ship trim during the displacements of the on-board masses and the movements generated by the sea or the ocean.

The elements of the vessel above the waterline, and in particular those which are on the deck, have a reduced height so that the centre of gravity of the vessel with its keel is very low. The vessel has no sail, mast or rigging, or any other equipment intended to use the force of the wind. In practice, it is designed to have a small wind resistance. It will hence have a low radar echo due to its shape, size and small height of the emerged parts. Its hull and the materials of which it consists may be chosen as a function of the needs; for example, metals for keeping a radar echo, or composite materials, in particular glass fibre, in the opposite case. Although the vessel does not use the wind for its propulsion and has hence no mast or other high appendix dedicated to the use of wind for propulsion, the vessel can however comprise masts serving in particular to carry the radio equipment devices and/or optical equipment devices and/or wind generator and/or sensors, as well as to bring as high as possible the potential air intakes useful for certain operating modes of the drone.

Figure 2:
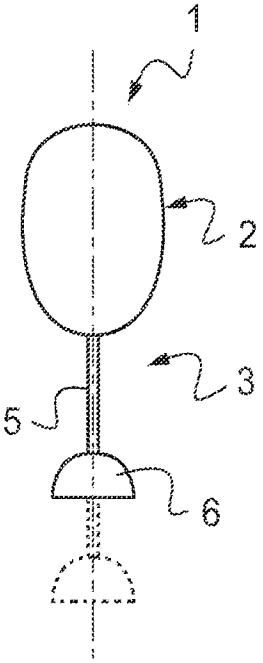
FIG. 2 is a vertical cross-sectional view of the vessel passing through the keel.
Figure 3:
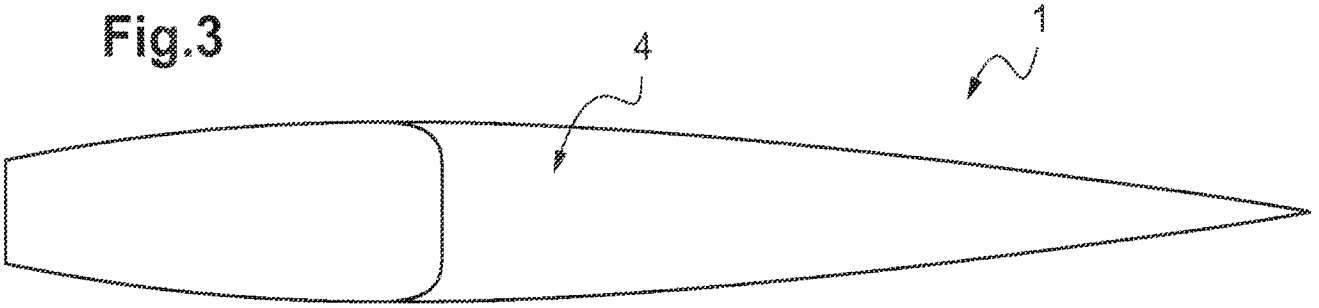
FIG. 3 is a top view of the vessel.

Thanks to the very narrow shape of the hull 2, also visible in FIGS. 2 and 3, the vessel 1 has a very small drag in view of its length. The hull 2 with the keel 3 allows minimizing the pitch movements. The hull 2 is able to exceed with very little energy the limit speed of the hull and to switch to overspeed without however having so-called "planing" shapes.

More precisely, the vessel 1 has a configuration that allows it to sail at speeds corresponding to a Froude number higher than 0.45. It is reminded that the Froude number is the ratio between the hull length and the speed. This hull length is lower than 20 metres and higher than 2.5 metres according to the embodiment and the maximum speed, still according to the embodiment, may reach 30 knots. Due to the heading and trailing shapes of the present vessel, which is a wave-piercing vessel, the hull length is in practice identical or almost-identical to the total length of the vessel.

The vessel 1, whose total length is lower than 20 metres and which has a minimum length of at least 2.5 metres, has a total width to total length ratio lower than 0.2.

With respect to the conventional mechanically propelled vessels that do not need one, and in particular the high-speed vessels for which it would be a handicap, it has a ballasted keel. This keel is useful to the stability of the present vessel, since the latter, which has a very tapered/fusiform shape, has no or almost no transverse shape stability, contrary to the conventional mechanically propelled vessels. It is reminded that the present vessel is intended for acoustic measurements in water and that it is not intended to "fly" above water, nor to "hover", because its keel contains measurement devices that must stay under water and whose movements must be the most damped possible. It must hence be able to pierce the waves while sailing at a high speed and with a reduced energy expenditure.

In this example, the vessel 1 also includes a rudder 7.

The vessel 1, which is not a small-scale model of an existing vessel, is a drone intended for acoustic measurements, with the acoustic measurement systems, in particular the acoustic wave transmission and reception transducers, arranged in the bulb 6 of the keel 3. Moreover, the keel 3, and in particular its bulb 6, also contains an attitude unit that allows accurate corrections of the acoustic measurements due to the fact that this attitude unit is positioned as close as possible as the acoustic transducers.

This vessel is autonomous in that it comprises mechanical propulsion means 12 and an inner source of energy. Hence, it is not a towed device and/or a device linked by a cable to another vessel or another floating or not-floating equipment.

Thanks to the shape of the hull 2, the drag is reduced both in still water and in rough water, and a reduction of the movements generated on the vessel 1 by the agitation of the waves is obtained. The shape of the vessel 1 and of its keel 3 allows improving the flows around the acoustic transducers and avoids the formation of bubbles having a masking effect at the acoustic transducers. It results therefrom a reduction of the "noises" causing interferences to the acoustic measurements in the traditional vessels.

This drone is hence mechanically propelled and an electric motor or an internal combustion engine or even a mixed motor, operating one or several propellers or one or several turbines, is used.

In a preferred embodiment, the keel 3 is dismountable and interchangeable. Moreover, in an advanced mode, the keel 3 may be arranged in a more or less raised position and it can hence be raised up, so that the draught of the ship can be reduced due to the fact that the keel can be positioned at different heights, varying that way the draught of the vessel.

It is also preferred that the bulb 6 of the keel 3 is interchangeable with respect to the keel, so that the drone can be used with different acoustic transducer configurations.

The invention claimed is:

1. A mechanically propelled, wave piercing surface vessel (1) devoid of any sail, mast or rigging for propelling the vessel by wind, comprising:

a fusiform hull (2) with a waterline; and a keel (3) in a lower part of the hull, the hull (2) being elongated in a longitudinal direction of the vessel, and the keel having a lower end, the keel (3) having at the lower end a bulb (6) linked to the hull by a linking part (5) of the keel, the linking part having a maximum width, the bulb having a maximum width, the maximum width of the linking part (5) being smaller than the maximum width of the bulb (6), the linking part having a maximum length, the bulb having a maximum length, the maximum length of the linking part (5) being smaller than the maximum length of the bulb (6), said lengths and widths being considered in the longitudinal direction of the vessel (1) and in a horizontal transverse direction perpendicular to the longitudinal direction, respectively, wherein the hull (2) has a total width to total length ratio of less than 0.2, and a maximum length of less than 20 metres, with a ratio of a hull height above the waterline and except possible appendices thereof to a hull height under the waterline lower than 0.8 and higher than 0.1, wherein a mechanical propulsion means of the vessel includes at least one electrical motor and/or internal combustion engine that operates one or more propellers or one or more turbines, wherein the vessel is configured to sail at speeds corresponding to a Froude number higher than 0.45 without planing, wherein the vessel is configured for acoustic measurements and contains acoustic measurement systems including acoustic wave transmission and reception transducers, and wherein at least the acoustic wave transmission and reception transducers are arranged inside the bulb (6) of the keel (3).

2. The vessel (1) according to claim 1, wherein the vessel is a drone, containing remote-controlled and/or pre-programmed computer navigation equipment.

3. The vessel (1) according to claim 2, wherein the vessel contains an attitude measurement unit including attitude measurement sensors, and wherein at least attitude measurement sensors are arranged in the bulb (6) of the keel (3).

4. The vessel (1) according to claim 3, wherein the keel (3) is adjustable in height under the hull (2) so that the depth of the bulb (6) with respect to the hull (2) can be adjusted.

5. The vessel (1) according to claim 4, wherein the keel (3) is interchangeable.

6. The vessel (1) according to claim 2, wherein the keel (3) is adjustable in height under the hull (2) so that the depth of the bulb (6) with respect to the hull (2) can be adjusted.

7. The vessel (1) according to claim 1, wherein the vessel contains an attitude measurement unit including attitude measurement sensors, and wherein at least attitude measurement sensors are arranged in the bulb (6) of the keel (3).

8. The vessel (1) according to claim 7, wherein the keel (3) is adjustable in height under the hull (2) so that the depth of the bulb (6) with respect to the hull (2) can be adjusted.

9. The vessel (1) according to claim 1, wherein the keel (3) is interchangeable.

10. The vessel (1) according to claim 9, wherein the vessel contains an attitude measurement unit including attitude measurement sensors, and wherein at least attitude measurement sensors are arranged in the bulb (6) of the keel (3).

11. The vessel (1) according to claim 9, wherein the keel (3) is adjustable in height under the hull (2) so that the depth of the bulb (6) with respect to the hull (2) can be adjusted.

12. The vessel (1) according to claim 1, wherein the keel (3) is adjustable in height under the hull (2) so that the depth of the bulb (6) with respect to the hull (2) can be adjusted.

13. The vessel (1) according to claim 12, wherein the vessel contains an attitude measurement unit including attitude measurement sensors, and wherein at least attitude measurement sensors are arranged in the bulb (6) of the keel (3).

14. The vessel (1) according to claim 12, wherein the keel (3) is interchangeable.

15. The vessel (1) according to claim 1, wherein the vessel (1) has a minimum length of at least 2.5 metres.

16. The vessel (1) according to claim 15, wherein the vessel contains an attitude measurement unit including attitude measurement sensors, and wherein at least attitude measurement sensors are arranged in the bulb (6) of the keel (3).

17. The vessel (1) according to claim 15, wherein the keel (3) is adjustable in height under the hull (2) so that the depth of the bulb (6) with respect to the hull (2) can be adjusted.

18. The vessel (1) according to claim 1, wherein the linking part (5) of the keel (3) has a substantially identical length over the whole height thereof.

19. The vessel (1) according to claim 18, wherein the vessel contains an attitude measurement unit including attitude measurement sensors, and wherein at least attitude measurement sensors are arranged in the bulb (6) of the keel (3).

20. The vessel (1) according to claim 1, wherein a ratio of the maximum width of the linking part to the maximum width of the bulb is comprised between 0.05 and 0.5.

* * * * *